US008974183B2

(12) United States Patent
Gleiner et al.

(10) Patent No.: US 8,974,183 B2
(45) Date of Patent: Mar. 10, 2015

(54) CERAMIC CORE TAPERED TRIP STRIPS

(71) Applicants: Matthew S. Gleiner, Vernon, CT (US); Matthew A. Devore, Cromwell, CT (US)

(72) Inventors: Matthew S. Gleiner, Vernon, CT (US); Matthew A. Devore, Cromwell, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/742,749

(22) Filed: Jan. 16, 2013

(65) Prior Publication Data

US 2013/0195675 A1 Aug. 1, 2013

Related U.S. Application Data

(63) Continuation of application No. 12/786,066, filed on May 24, 2010, now Pat. No. 8,353,329.

(51) Int. Cl.

| | |
|---|---|
| ***B22C 9/10*** | (2006.01) |
| ***F01D 5/18*** | (2006.01) |
| ***B22C 7/06*** | (2006.01) |

(52) U.S. Cl.

CPC . *B22C 9/10* (2013.01); *F01D 5/187* (2013.01); *B22C 7/06* (2013.01); *B22C 9/103* (2013.01); *F05D 2240/122* (2013.01); *F05D 2240/304* (2013.01); *F05D 2230/21* (2013.01); *F05D 2250/292* (2013.01); *F05D 2260/22141* (2013.01)

USPC ..... 416/97 R

(58) Field of Classification Search

USPC ..... 415/115; 416/96 A, 96 R, 97 A, 97 R

See application file for complete search history.

(56) References Cited

U.S. PATENT DOCUMENTS

| | | | | |
|---|---|---|---|---|
| 5,052,889 | A * | 10/1991 | Abdel-Messeh | 416/97 R |
| 5,695,321 | A * | 12/1997 | Kercher | 416/97 R |
| 6,179,565 | B1 | 1/2001 | Palumbo et al. | |
| 6,406,260 | B1 * | 6/2002 | Trindade et al. | 416/96 R |
| 6,666,262 | B1 * | 12/2003 | Parneix et al. | 165/109.1 |
| 7,093,645 | B2 | 8/2006 | Grunstra et al. | |
| 7,234,506 | B2 | 6/2007 | Grunstra et al. | |
| 7,278,460 | B2 | 10/2007 | Grunstra et al. | |
| 2007/0284411 | A1 | 12/2007 | Luczak | |
| 2010/0122789 | A1 | 5/2010 | Piggush et al. | |

FOREIGN PATENT DOCUMENTS

| | | |
|---|---|---|
| EP | 1671720 | 6/2006 |
| WO | 2009150019 | 12/2009 |

OTHER PUBLICATIONS

European Search Report for European Patent Application No. 11166387.8-1353 completed on Mar. 20, 2013.

* cited by examiner

*Primary Examiner* — Nathaniel Wiehe
*Assistant Examiner* — Woody A Lee, Jr.
(74) *Attorney, Agent, or Firm* — Carlson, Gaskey & Olds, P.C.

(57) ABSTRACT

A core die for creating an airfoil includes a first section, a second section mating with the first section, and an insert for creating a slot. The first section and the second section define a body having an outer dimension. The insert is disposed at an angle to the outer dimension. A trip strip includes a first portion disposed in the second section. The first portion is in register with the insert and a thickness is maintained between the first portion and the insert along a length of the insert. The first portion tapers towards the outer dimension and the thickness is filled by the ceramic material between the slot and the first portion.

4 Claims, 3 Drawing Sheets

CERAMIC CORE TAPERED TRIP STRIPS

CROSS REFERENCE TO RELATED APPLICATIONS

The present disclosure is a Continuation of U.S. patent application Ser. No. 12/786,066, filed Jun. 1, 2010.

GOVERNMENT RIGHTS

This invention was made with government support under Contract No. F33615-03-D-2354-0009 awarded by the United States Air Force. The Government has certain rights in this invention.

BACKGROUND OF THE INVENTION

Materials used in the turbine section of a gas turbine engine may be subjected to temperatures that are above the melting point of those materials. To operate under such high temperatures, the parts using those materials must be internally cooled. Turbine airfoils, for example, use internal cores that form hollow passages within the airfoils. In high heat load applications, trip strips may be used within these passages to further enhance convective cooling.

It is typical in the art, for a ceramic material to be injected into a metal die and then fired to form desired core passages of a turbine airfoil. Slots are built into the die into which a RMC (Refractory Metal Core) is inserted. The RMC is stamped or cut out and then put into form dies to achieve the desired 3D shapes. The RMC is then attached into the slots in the ceramic core. At this point, the sacrificial die is prepared for further processing such as a lost wax process, investment casting or the like.

SUMMARY OF THE INVENTION

A core die according to an aspect of the present disclosure includes a first section, a second section mating with the first section, and an insert for creating a slot. The first section and the second section define a body having an outer dimension. The insert is disposed at an angle to the outer dimension. A trip strip includes a first portion disposed in the second section. The first portion is in register with the insert and a thickness is maintained between the first portion and the insert along a length of the insert. The first portion tapers towards the outer dimension and the thickness is filled by the ceramic material between the slot and the first portion.

In a further non-limiting embodiment of any of the foregoing examples, the first portion and the second portion of the trip strips each have a portion not in plane with each other.

In a further non-limiting embodiment of any of the foregoing examples, the first portion is tapered along a portion of the length thereof.

In a further non-limiting embodiment of any of the foregoing examples, the first portion and the second portion of the trip strip are angled relative to each other.

An airfoil according to an aspect of the present disclosure includes an inner passageway for cooling the body, a trip strip which has a first portion disposed within the inner passageway, and the first portion tapers into an area which requires increased cooling.

A further non-limiting embodiment of any of the foregoing examples, the trip strip includes a second portion disposed at an angle from said first portion.

In a further non-limiting embodiment of any of the foregoing examples, the first portion and the second portion of the trip strips are in plane with each other.

These and other features of the present invention can be best understood from the following specification and drawings, the following of which is a brief description.

DETAILED DESCRIPTION OF THE PREFERRED EMBODIMENT

Figure 1:
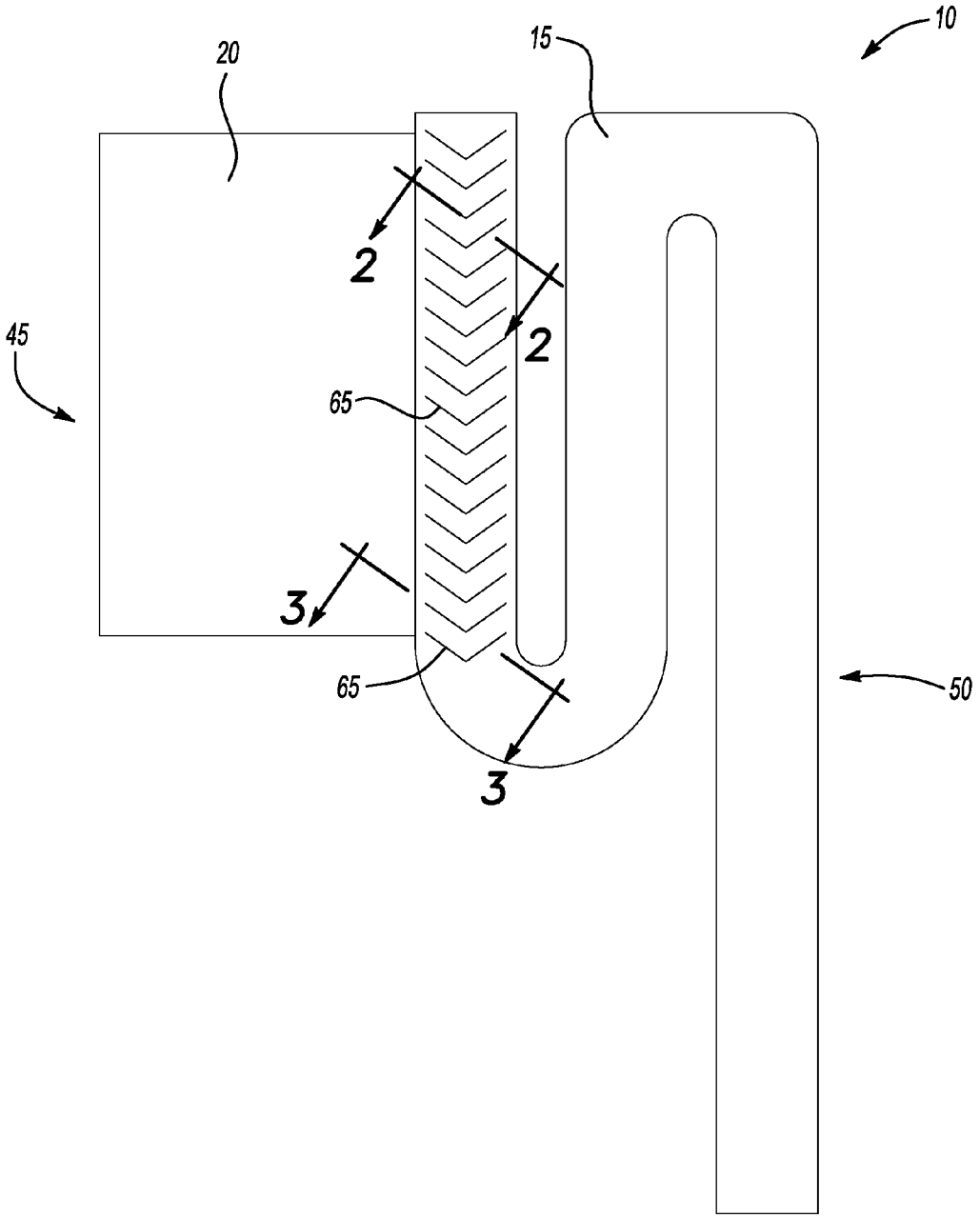
FIG. 1 is a side, perspective view of a ceramic core including an RMC insert.
Figure 5:
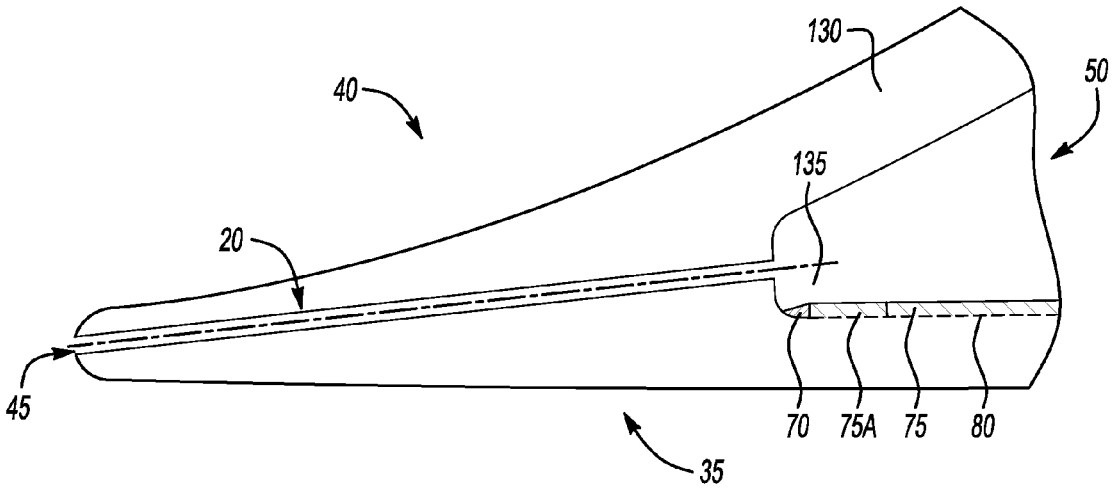
FIG. 5 is a partial, cross-sectional view of a turbine blade made from the ceramic core and RMC insert of FIG. 1.

FIG. 1 shows a sacrificial core assembly 10 used in making a turbine blade 130 (see FIG. 5). The sacrificial core assembly 10 has a ceramic core 15 and an RMC 20, also known as a Refractory Metal Core, that acts as an insert and is attached into a slot 25 (see the ceramic core 15 shown in die 90 in FIG. 2 and isolated in FIG. 3) in the ceramic core 15. The ceramic core 15 has a plurality of trip strips 65 that provide enhanced heat transfer to cool a turbine blade 130 (see FIG. 5). The ceramic core 15 has an outer dimension including a suction side 35, a pressure side 40, a trailing edge 45, a leading edge 50 and slot 25 (see FIGS. 2 and 3) for RMC 20 to be inserted. The RMC may be secured in the slot in several ways including gluing or mechanical means, such as clips or the like (not shown).

Figure 2:
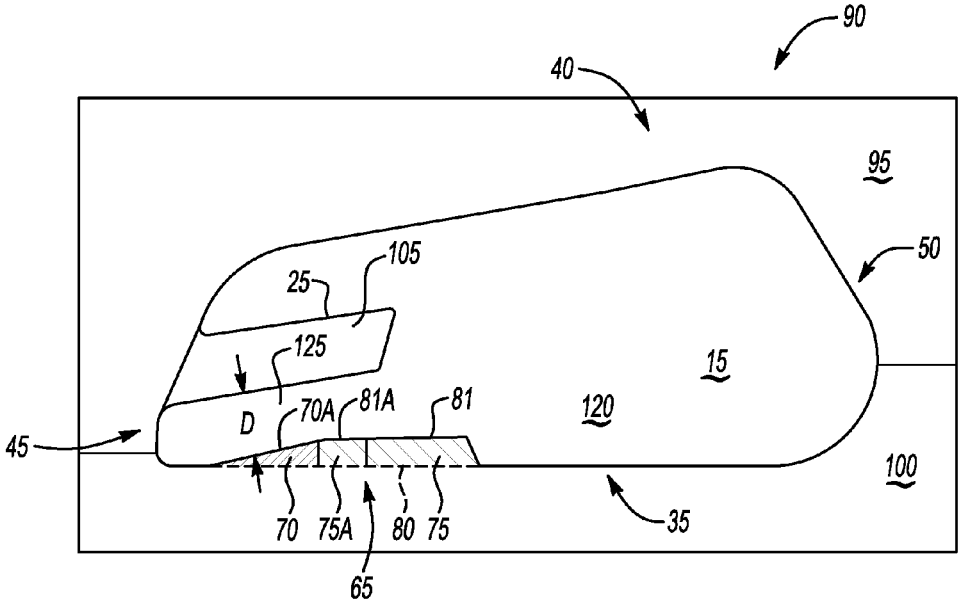
FIG. 2 is a cut-away view of the core of FIG. 1, taken along the line 2-2, shown in a ceramic core mold.
Figure 3:
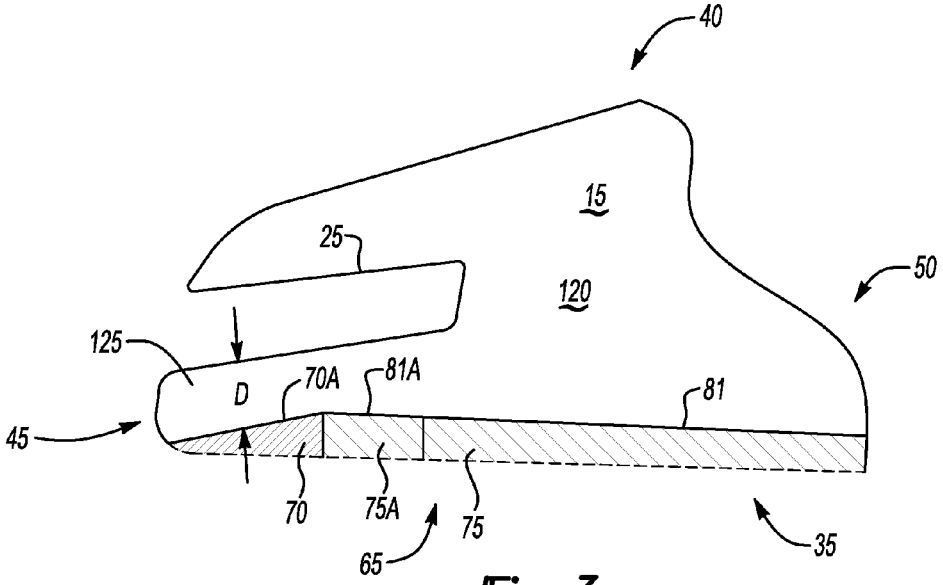
FIG. 3 is a cut-away view of the core of FIG. 1 taken along the line 3-3.

Referring to FIGS. 2 and 3, a plurality of trip strips 65 extend along a length of the suction side 35 of the ceramic core 15. The trip strips 65 are shown adjacent the trailing edge 45 of the suction side 35 but may be placed anywhere heating loads in or on the turbine blade 130 make additional cooling desirable.

This description shows trip strips 65 placed towards the trailing edge 45 of the ceramic core 15, while still allowing for adequate dimension D, such as thickness or depth or the like, from the slot 25 to maintain manufacturability as will be discussed herein. Without the placement of the tapered trip strip portion 70, trip strip coverage is reduced to accommodate minimum ceramic core thickness requirements for manufacturing and required cooling may not be provided. Trip strips 65 may be of any size, shape and configuration (straight, chevron—see FIG. 4, etc.) as may be required to provide cooling. Although this disclosure shows the trip strips 65 on the suction side 35, all the same concepts could be used with trip strips on either the suction side 35 or pressure side 40, depending on the cooling requirements of the particular part.

Figure 4:
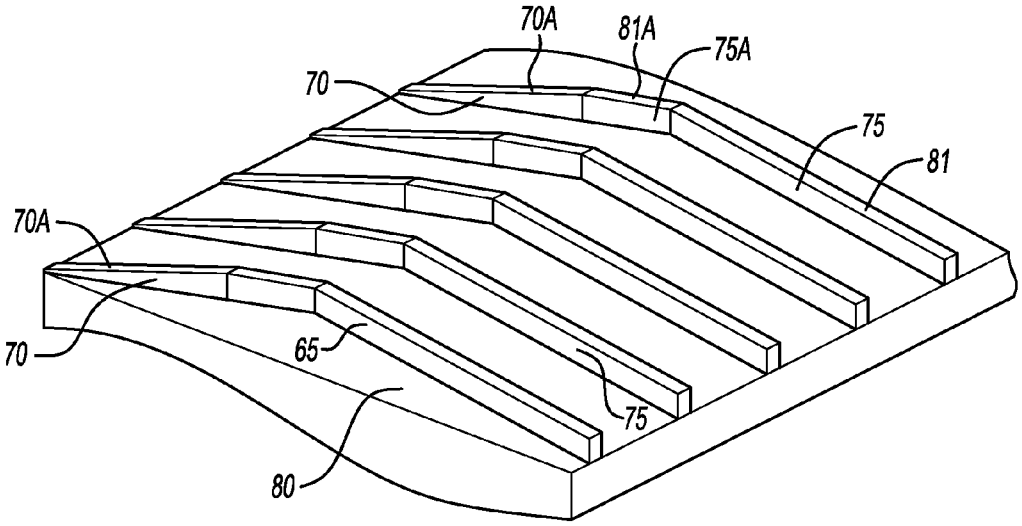
FIG. 4 is a partial view of the core die, which is a negative of the core.

Referring now to FIG. 4, the negative features to produce trips strips 65 of a core die 90 are shown. Each trip strip 65 has a portion 75, which is elongated and has a rectangular cross-section. The portion 75, which may have an angled part 75A attached thereto to form a chevron, is attached to a tapered portion 70. Both the portion 75 and tapered portion 70 are disposed on a wall 80, which is the same surface on a finished blade (see FIG. 5). Each tapered portion 70 tapers towards the wall portion 80 from the portion 75A. The tops 81 and 81A are in plane but the top 70A of portion 70 tapers downwardly out of plane with tops 81 and 81A of portions 75 and 75A thereby creating taper portion 70. One of ordinary skill in the art will recognize that the tapered portion 70 may disposed on any portion of the trip strip 65 to accommodate an area 125 between the slot 25 and the wall 70A (see FIG. 2) as will be discussed hereinbelow and as may be required by a particular design. Taper portion 70 also need not be attached to a portion 75 to be functional herein. Similarly, both the taper portion 70 and the portion 75 may have other cross-sectional dimensions and such other shapes are contemplated herein.

Referring now to FIG. 2 and the core die 90 shown in FIG. 4, the ceramic core 15 is shown along lines 2-2. The ceramic core 15 is formed in a core die 90 having a first half 95, a second half 100 and a manufacturing insert 105 that is removably attached to the respective core die 90 halves 95 and 100 or sections, as is known in the art. The ceramic core 15 shows portions 75A of the trip strips 65 and the tapered portions 70 of the trip strips 65. The trip strips 65 come out of the core die 90 as shown in FIG. 3.

Referring now to FIG. 2, the core die 90 includes the insert 105 and ceramic material 120 is inserted into the core die 90. The ceramic material flows to all areas of the core die 90, however, areas in which the ceramic material 120 flows must have a dimension such as minimum thickness to allow the material to fill the core die 90 as well as provide strength in the finished ceramic core. For instance the area 125 between the tapered portion 70 of the trip strip 65 and the slot 105 has a thickness D, which is dependent on the type of ceramic material used, to allow the ceramic material 120 to fill the area 125 to the trailing edge 45. It should be noted that the dimension D may vary for given ceramic materials.

By recognizing the need for a thickness D, the trip strip portion 70 may be tapered while maintaining the thickness D to allow for the tapered portion 70 to extend closer to trailing edges of the ceramic core 15. If the thickness D is not maintained, the ceramic material 120 may not flow to the trailing edge 45 or breakage in the finished ceramic core may be experienced. The trip strip portion 70 tapers in register with the shape of the slot 25 so that the thickness D is maintained in area 125.

Referring to FIGS. 2, 3 and 5, the ceramic core 15 is removed from the core die 90 and the insert 105 is removed from the ceramic core 15. The RMC 20 is attached into slot 25. The ceramic core 15 and the RMC are sacrificed, as is known in the art, to make the turbine blade 130 shown partially in FIG. 5. The RMC 20 and ceramic core 15 become shaped opening 135 (of the finished part—see FIG. 5) and the trip strips 65, including the tapered portion 70 and portions 75 are distributed along the outer edges of the opening 135. Because of the tapered portions 70 of surface the trip strips 65, the trip strips 65 can now be distributed to a greater area of the shaped opening 135.

Typically, trip strips 65 can be placed anywhere within the turbine blade 130. However, when forming the ceramic core 15, there must be enough room in the core die 90 to allow for the manufacturability of the ceramic core 15 and a certain dimension such as minimum thickness D must be allowed. Prior art cores have not been designed to accommodate trip strips 65 where they would be most useful. This disclosure allows for the additional of trip strips 65 in areas 135 not previous thought as suitable for trip strips.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. An airfoil comprising;

a body including;

an inner passageway for cooling said body, a trip strip having a first portion disposed within said inner passageway and a second portion disposed within said inner passageway, said first portion tapering into an area requiring increased cooling, said second portion disposed at an angle from said first portion;

said first portion comprises a first section and a second section;

said second portion comprises a single top surface;

a top surface of said second portion and said first section of said first portion are in plane with each other; and a top surface of said second section of said first portion is out of plane with the top surface of said second portion and said first section of said second portion.

2. The airfoil of claim 1 wherein said first portion and said second portion of said trip strips are in plane with each other.

3. The airfoil of claim 1, wherein the tapering of said first portion is restricted to the second section of the first portion.

4. The airfoil of claim 1, wherein the first section of the first portion is disposed at an angle from said second portion.

* * * * *